United States Patent [19]

Gagnon

[11] Patent Number: 5,067,190

[45] Date of Patent: Nov. 26, 1991

[54] COMBINATION TOOL ASSEMBLY

[76] Inventor: Yvon Gagnon, 231, 1st Avenue, Saint-Honoré , Canada, G0V 1L0

[21] Appl. No.: 512,804

[22] Filed: Apr. 23, 1990

[51] Int. Cl.[5] ..... B25F 1/02

[52] U.S. Cl. ..... 7/149; 7/158; 7/170; 30/308.3

[58] Field of Search ..... 30/308.1, 308.3; 7/145, 7/148, 149, 158, 159, 167, 170, 106

[56] References Cited

U.S. PATENT DOCUMENTS

| | | | |
|---|---|---|---|
| 292,184 | 1/1884 | Thompson . | |
| 806,515 | 12/1905 | Baumgartner . | |
| 854,891 | 5/1907 | Huffman | 30/308.1 |
| 898,667 | 9/1908 | Melton . | |
| 981,786 | 1/1911 | Montgomery | 7/148 |
| 2,576,869 | 11/1951 | Woltemath . | |
| 3,627,007 | 12/1971 | Rieffer | 145/2 R |
| 4,023,221 | 5/1977 | Cadman | 7/1 R |
| 4,114,216 | 9/1978 | Gathy | 7/116 |

FOREIGN PATENT DOCUMENTS

| | | | |
|---|---|---|---|
| 958291 | 3/1950 | France | 7/145 |
| 1217115 | 5/1960 | France | 7/149 |

*Primary Examiner*—Mark Rosenbaum
*Assistant Examiner*—John M. Husar
*Attorney, Agent, or Firm*—Pierre Lesperance

[57] ABSTRACT

This combination tool assembly forms a combination of cutting hand tools including a hatchet, a handsaw and a utility knife configurations with an assortment of interchangeable handsaw blades of different uses and a hatchet handle adapted to enclose the unused handsaw and knife components while the tool is in the hatchet configuration and a handsaw handle forming a cap for the case formed by the hatchet handle and forming a grip for the latter in the hatchet configuration.

5 Claims, 4 Drawing Sheets

27
10
23

12
32
35
30
10

34
37
36
38
23
13
13
15
21
39
32
30
35
42

COMBINATION TOOL ASSEMBLY

FIELD OF THE INVENTION

The present invention relates to a combination tool assembly and more particularly to an assembly of the type constructed and arranged to form a combination of cutting hand tools including a hatchet and a handsaw configurations.

BACKGROUND OF THE INVENTION

There have been anteriorly proposed different concepts of hand tools adapted to provide such combination of hand tools or hand tool functions. Those concepts merely include a hatchet having an ax head remaining fixed to its handle and an auxiliary saw blade that is merely unfolded to a handsaw configuration with the ax head remaining in place.

Such prior art concepts are found in U.S. Pat. No. 292,184 to Thompson, U.S. Pat. No. 805,515, to Baumgartner, and U.S. Pat. No. 2,576,869 to Woltemath. In each of those patents, the saw blade merely retracts into a slot in the handle of the hatchet with the ax head remaining fixed to the handle, even in the handsaw configuration.

There results that the cutting edge of the ax head constitutes a hazard for the user. Besides, only one type of saw blade is available, and this seriously impairs the utility of such combination tool. It must be noted that those prior art concepts do not provide any space for carrying other saw blades or tools.

OBJECTS OF THE INVENTION

It is therefore a general object and advantage of the present invention to provide an improved combination tool assembly of the above-mentioned type.

It is a general object of the present invention to provide a combination tool assembly of the above type, wherein the ax head is detachable to produce a safe handsaw configuration.

It is another general object of the present invention to provide a combination tool of the above type, which is of relatively more universal utility than had been achieved so far.

It is a more specific object of the present invention to provide a combination tool of the above type, which produces a hatchet configuration, a handsaw configuration and a utility knife configuration with an assortment of interchangeable handsaw blades of different uses and a hatchet handle adapted to enclose the unused handsaw and knife components while the tool is in the hatchet configuration.

It is another object of the present invention to provide a combination tool assembly of the above type, wherein the handle of the hatchet and the handle of the handsaw cooperatively and conveniently form a tubular case to enclose the unused components of the assembly while in the hatchet configuration.

SUMMARY OF THE INVENTION

The present invention provides a combination tool adapted to form a hatchet configuration, a handsaw configuration, and a utility knife configuration and in which the ax head is removable from the handle of the hatchet, and in which the handle of the hatchet is hollow to form a tubular case for all the unused handsaw and knife components and for an assortment of readily-interchangeable handsaw blades.

BRIEF DESCRIPTION OF THE DRAWINGS

The above and other objects and advantages of the present invention will be better understood with reference to the accompanying drawings, which illustrate by way of example a preferred embodiment of the invention and in which.

DETAILED DESCRIPTION OF A PREFERRED EMBODIMENT

Figure 1:
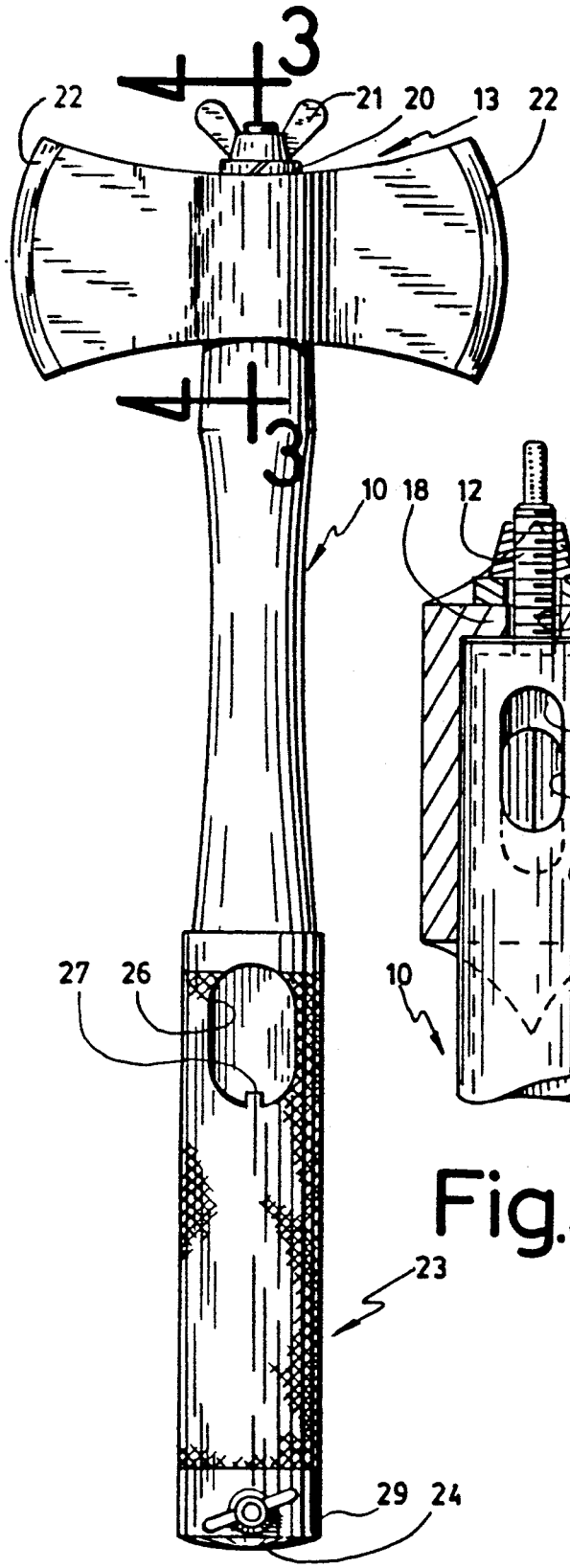
FIGS. 1 and 2 are side views at 90 degrees one relative to the other of the combination tool assembly according to the present invention and shown in the hatchet configuration.
Figure 2:
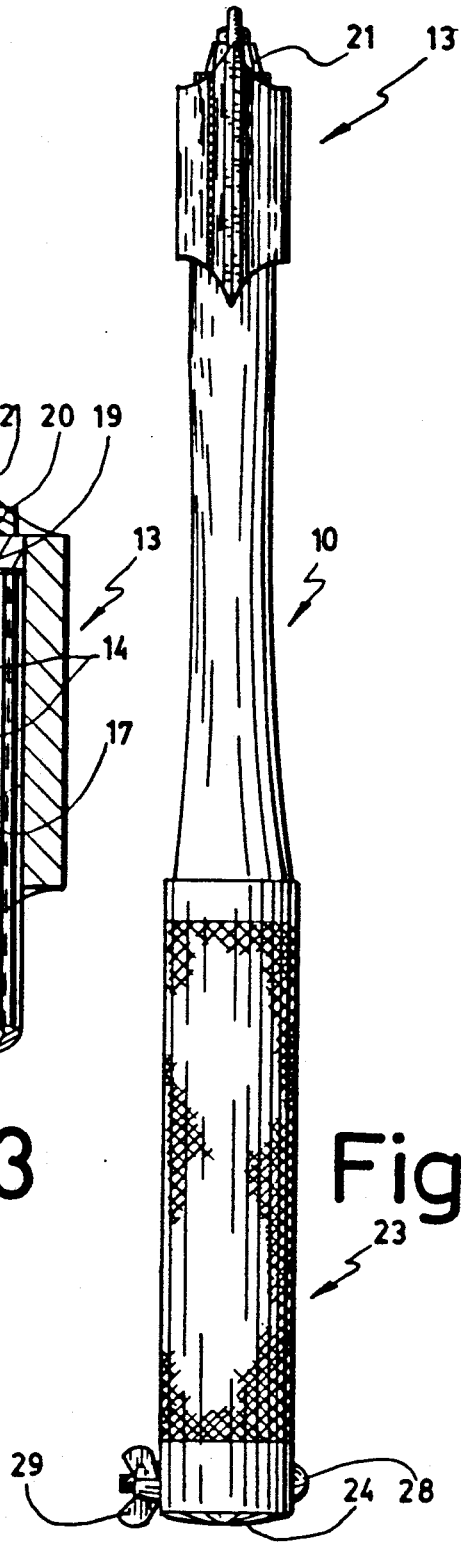

The combination tool assembly according to the present invention includes a plurality of components which are constructed and arranged to form the hatchet configuration shown in FIGS. 1 and 2 with all the unused components fitting into the hatchet handle and thus being all carried in the hatchet.

Figure 4:
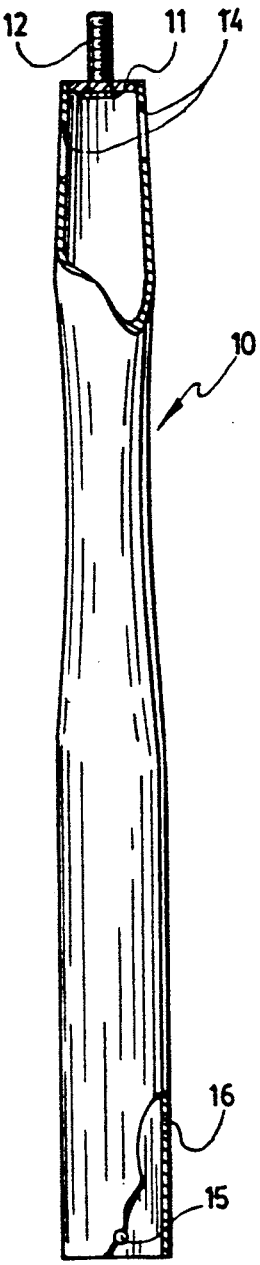
FIGS. 4 and 5 are side views of the hatchet handle as seen at 90 degrees relative one to the other and partly broken away in FIG. 4.
Figure 5:
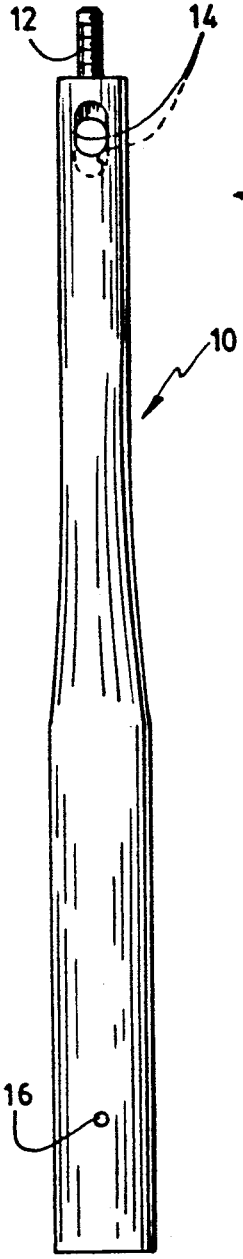
Figure 7:
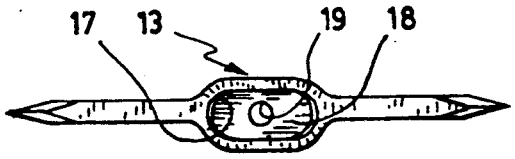
FIG. 7 is an axial view of the ax head forming part of the hatchet configuration shown in FIGS. 1, 2, and 3.
Figure 10:
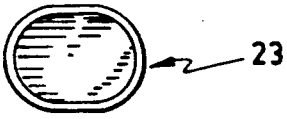
FIG. 10 is an inner open end view of the handle of FIG. 8.
Figure 8:
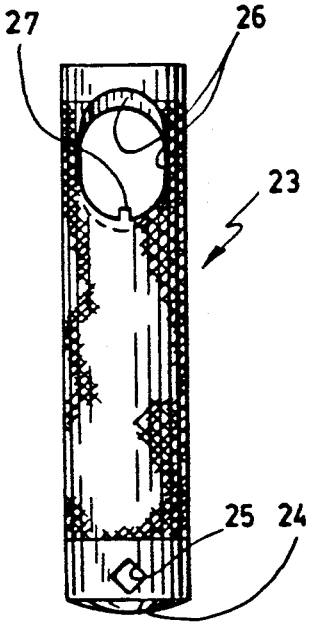
FIGS. 8 and 9 are side views of the handsaw handle as seen at 90 degrees relative one to the other and partly broken away in FIG. 9.
Figure 9:
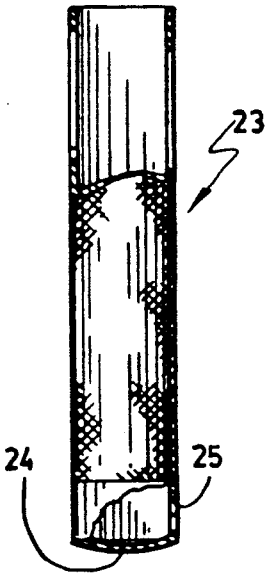
Figure 6:
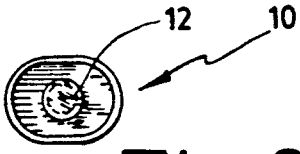
FIG. 6 is an end view of the hatchet handle as seen from the bottom in FIG. 4.

The combination tool assembly includes a hatchet handle 10 having the form of a hammer handle, as best seen in FIGS. 4 and 5. The hatchet handle 10 is tubular, closed at one end at 11, and open at the other end, thus forming a tubular case. A bolt 12 is axially secured in the closed end 11 and outwardly projects from it. The closed end is laterally flattened and outwardly tapers in conventional manner to tightly fit the ax head 13 on it. A hole 14 extends through both opposite sides of the hatchet handle at its closed end and its axis is inclined relative to the longitudinal direction of the handle. The open end of the hatchet handle is provided with a small transverse hole 15 extending through both sides and near the end. Another hole 16 is also provided inward of the transverse hole 15 and through only one side of the handle.

Figure 3:
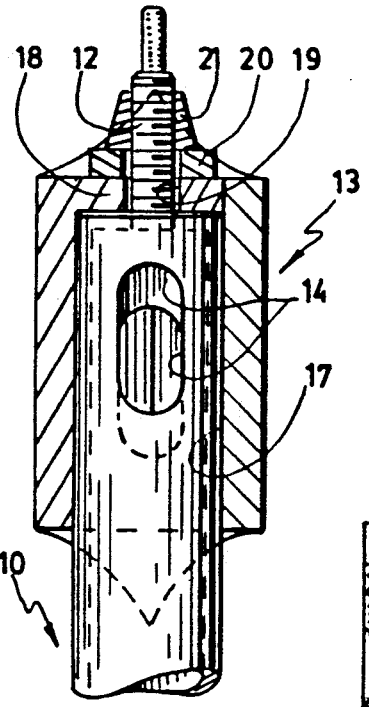
FIG. 3 is a longitudinal-sectional view as seen along line 3—3 in FIG. 1.

The ax head 13 has a central portion formed with an axial cavity 17 adapted to tightly receive the tapering closed end of the hatchet handle 10, as best shown in FIG. 3. The axial cavity 17 is closed at one end by a wall 18, having a hole 19 through which the bolt 12 outwardly projects. A lock washer 20 and a wing nut 21 engage around the bolt 12 and tightly secures the hatchet handle in the bore 17 of the ax head 13. The latter includes a pair of cutting edges 22 outwardly projecting diametrically opposite one from the other.

A handsaw handle 23, of tubular construction, also forms part of the combination tool assembly. The handsaw handle 23 includes a closed end 24 and an opposite open end. The handsaw handle is of complementary shape and size to slide over the free outer end or open end of the hatchet handle to form a cap on that open end. Thus, as can be seen in FIGS. 1 and 2, the hatchet handle 10 and the handsaw handle 23 cooperatively form a closed tubular case. The handsaw handle 23 has a knurled outer surface and also forms a grip when in the hatchet configuration.

The handsaw handle 23 has a square hole 25 extending transversely through both sides thereof near the closed end 24. A hole 26 extends through opposite sides of the handsaw handle near its open end and its axis is inclined in the longitudinal direction of the handle. A lug 27 projects in the hole 26 on one side of the handle. In the hatchet configuration, as seen in FIGS. 1 and 2, a bolt 28 transversely extends through the registering holes 15 and 25 of the hatchet handle and handsaw handle respectively and a wing nut 29 secures that bolt in place. These two handles thus form a closed tubular case in which all the elements of FIG. 11 may be carried.

Figures 12, 13, 14:
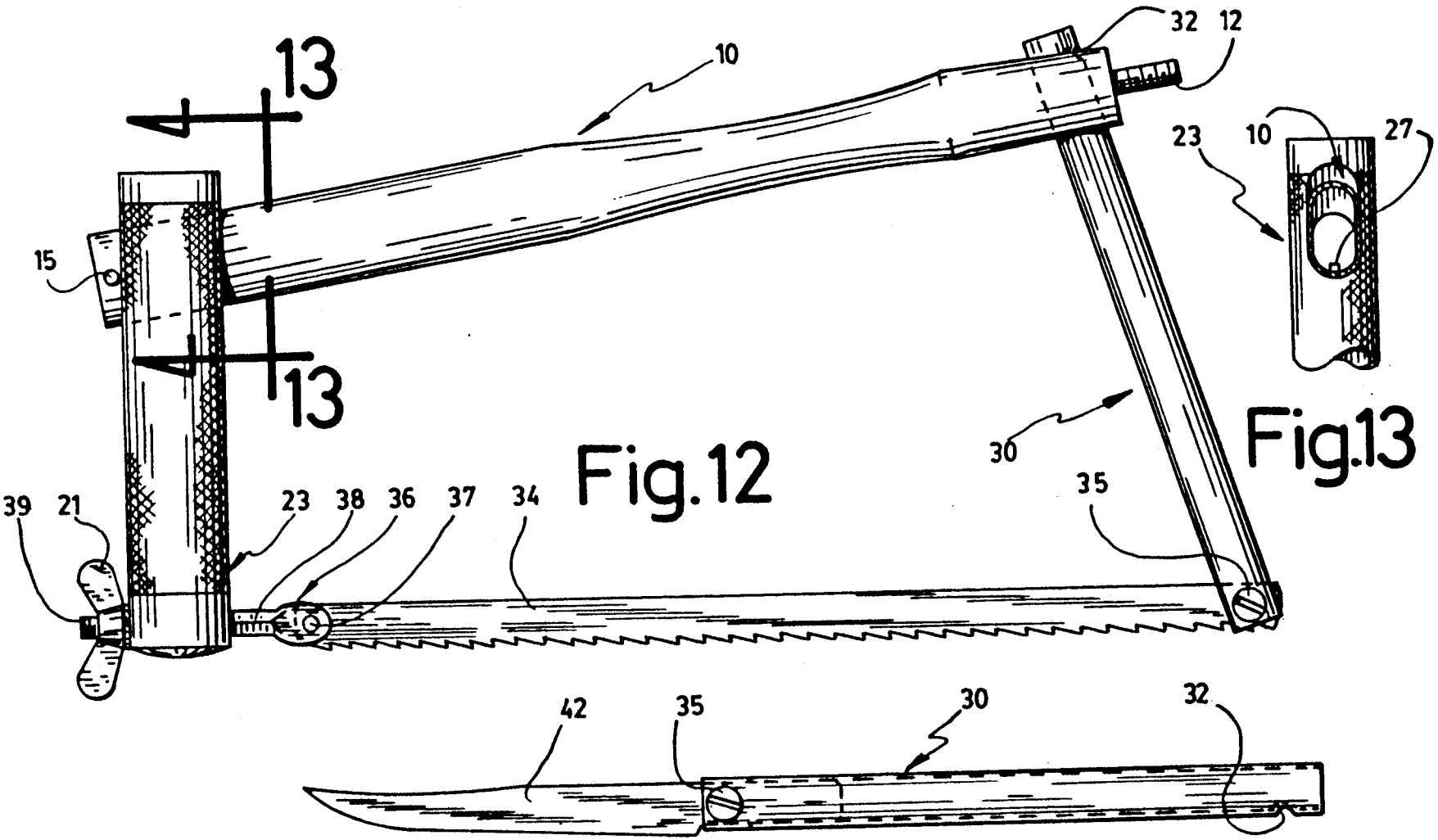
FIG. 12 is a side elevation view of a handsaw assembly and configuration that are formed by components of the combination tool assembly according to the present invention.
FIG. 13 is a cross-sectional view as seen along line 13—13 in FIG. 12.
FIG. 14 is a side view of a utility knife configuration formed by appropriate components of the combination tool assembly according to the present invention.

Referring now to FIG. 12, the combination tool assembly according to the present invention includes other components to form the illustrated handsaw configuration. The additional components include a tubular utility knife handle 30 to complete a handsaw frame cooperatively with the hatchet handle 10 and the handsaw handle 23. The knife handle 30 (see FIG. 11) is open ended with a transverse hole 31 at one end, a notch 32 at the opposite end, and a longitudinal cut 33 intersecting the hole 31. The handsaw frame includes insertion of the open end of the hatchet handle 10 into the hole 26 of handsaw handle 23 with engagement of the lug 27 into the hole 16 of the hatchet handle. For this purpose, handle 23 is oriented, so that lug 27 is at the inside of the handsaw frame. The frame also includes insertion of the notched end of the knife handle 30 into the hole 14 such that the notch 32 engages the wall of handle 10. For this purpose, knife handle 30 is oriented so that notch 32 is at the outside of the handsaw frame. A handsaw blade 34 is assembled to the frame by inserting one end through slits 33 of knife handle 30 and securing by a screw 35 and by using a tensioning screw 36 at the other end of blade 34. The tensioning screw 36 includes a lateral finger 37, a central portion 38, of square cross-section, and a threaded end 39. The tensioning screw 36 is slidably mounted in the hole 25 of the handsaw handle 23, and its complementary square cross-section prevents its rotation on itself to hold the blade 34 in the plane of the handsaw frame. The afore-mentioned wing nut 21 engages on the threaded end portion 39 to tension the blade 34, as is known in the art of metal handsaws. Tension exerted by blade 34 on handles 23 and 30 tends to pivot them relative to handle 10 in an inward direction, causing positive engagement of lug 27 within hole 16 and of the edge of one hole 14 within notch 32.

Figure 11:
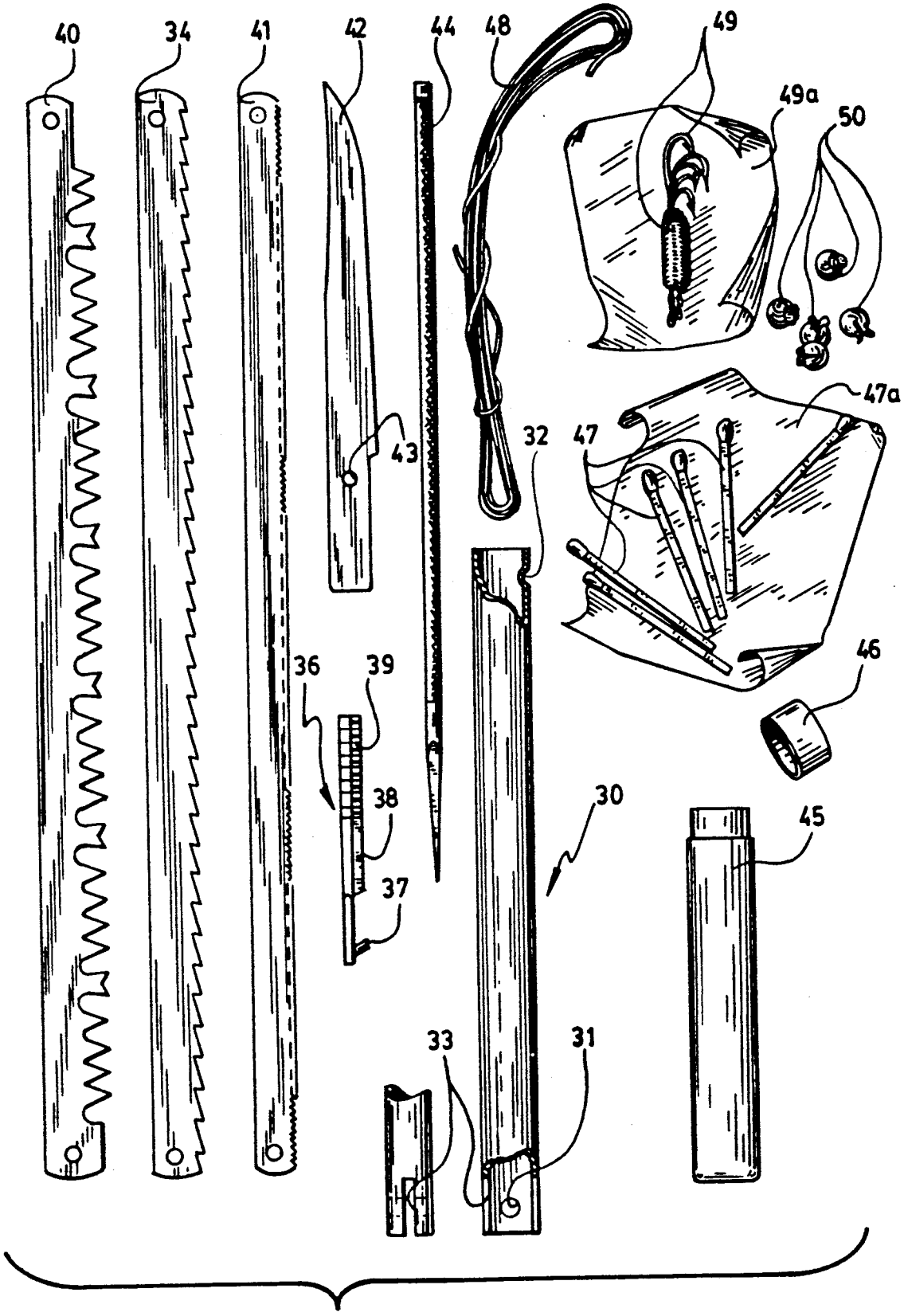
FIG. 11 is a view of an assortment of handsaw blades, a knife blade, and a utility knife handle forming part of the combination saw assembly and of other useful elements that can all fit in the hatchet handle.

As can be seen in FIG. 11, the hollow hatchet handle 10 provides space to carry an assortment of handsaw blades for different uses including the blade 34, a cross-cut blade 40, and a blade 41 for metals. A knife blade 42, with a transverse hole 43, is provided to form a utility knife configuration in cooperation with the knife handle 30 and the screw 35, as seen in FIG. 14.

In addition to the above-mentioned components to achieve the hatchet, the handsaw, and the knife configurations, the combination tool assembly provides sufficient space in the hatchet handle 10 to carry other useful elements such as a file 44, a watertight tube 45, with a cap 46 for matches 47 to be wrapped in a waterproof sheet 47*a*, an animal snare wire 48, an assembly of fishing hooks with a fishing line wound therearound, the assembly to be wrapped in a protecting sheet 49*a*, and fishing weights 50. Obviously, the choice of these additional elements may vary, depending on the activities of any particular user and on the size of the hatchet handle 10.

The tool assembly when in hatchet configuration and the other elements stored in the hatchet handle, is preferably of such a size that it can be carried in a case, or support hung from one's waist belt.

I claim:

1. A dismantleable bucksaw defining an open quadrangular frame in assembled condition and a single tubular body in dismantled condition, said bucksaw consisting of:

(a) an elongated saw blade having one and another ends;

(b) a tubular hollow handle, defining a closed end and a opposite mouth portion provided with an axially offset, first, transverse through-channel;

(c) first securing means, operative in said assembled condition for releasably anchoring said blade one end to said handle closed end transversely thereof;

(d) an elongated brace member, defining one and another end;

(e) second securing means, operative in said assembled condition for releasably anchoring said brace member one end to said blade other end;

(f) an elongated hollow shaft, defining a mouth portion and a closed end portion having an axially offset, second, transverse through-channel; wherein in said dismantled condition, said brace member and blade are fully engaged into the hollow of said shaft through said mouth portion thereof, and the handle is then fitted by its mouth portion onto said shaft mouth portion exteriorly thereof to close the latter and thus to fully enclose the brace and blade therewithin; and wherein in said assembled condition, said brace member endwisely releasably engages said second through-channel, said shaft endwisely releasably engages said first through-channel, and said brace member makes an acute angle with respect to said blade.

2. A dismantleable bucksaw defining an open quadrangular frame in assembled condition and a single tubular body in dismantled condition, said bucksaw consisting of:

(a) an elongated bucksaw blade, defining a first long cutting edge outwardly of said quadrangular frame and first and second opposite ends;

(b) a rigid tubular handle, defining a cylindrical hollow having a first closed end portion and a mouth at its opposite second end portion, said handle mouth portion defining axially offset, transversely registering, first and second, opposite through-bores, defining a first through-channel;

(c) first securing means, operative in said assembled condition thereof for releasably anchoring said bucksaw blade first end to said handle closed end portion at right angle thereof;

(d) an elongated brace member, defining first and second ends;

(e) second securing means, operative in said assembled condition thereof for releasably anchoring said brace first end to said bucksaw blade second end; and (f) a rigid, elongated, hollow shaft, defining a first closed end portion and a second open end mouth portion, the closed end portion thereof defining axially-offset, transversely registering, third and fourth, opposite through-bores forming a second through-channel;

said handle shorter in length than said brace member, said brace member, shorter than said bucksaw blade, said bucksaw blade, slightly shorter in length than said shaft; the outer diameter of said shaft mouth portion being smaller than the inner diameter of said handle hollow, and said bucksaw blade and brace member both diametrally smaller than said handle inner diameter;

wherein in said assembled condition thereof:

said first and second through-channels extend along axes coplanar to said bucksaw blade, said first through-bore being on the side of said bucksaw blade and being the proximal one of said first and second through-bores relative to said handle mouth, said brace second end portion releasably engaging said second through-channel and said shaft second end portion releasably engaging said first through-channel, said third through-bore being on the side of said bucksaw blade and being the distal one of said third and fourth through-bores relative to said brace first end, whereby said brace member and bucksaw blade make a large acute angle relative to one another, said handle and shaft, a small obtuse angle relative to one another, and said shaft and brace member, a small obtuse angle relative to each other;

and whereas in the dismantled condition thereof:

said first and second securing means are deactivated, said shaft withdrawn from said first through-channel and said brace member withdrawn from said second through-channel; said bucksaw blade and brace member are releasably engaged through said shaft mouth into the storage compartment defined by said shaft inner hollow, and the handle is then fitted by its mouth portion onto said shaft mouth portion exteriorly thereof to close the latter and thus to fully enclose the brace and blade therewithin.

3. A bucksaw as defined in claim 2, further including an ax head and means for releasably anchoring said ax head transversely of said shaft closed end; wherein said bucksaw forms part of a combination tool assembly whereby said shaft and ax fixedly secured to the shaft can be alternately used independently as a hatchet.

4. A bucksaw as defined in claim 2, further including a knife blade and means for releasably anchoring said knife blade axially to said brace first end; whereby said bucksaw forms part of a combination tool assembly whereby said brace member and knife blade fixedly secured to the brace member can be used independently as a knife member.

5. A bucksaw as as defined in claim 2, further including at least one tool chosen from the group consisting of a file, a watertight match container tube, an animal snare wire, an assembly of fishing hooks with a fishing line wound therearound, fishing weights, and a knife member; said at least one tool being of such overall dimensions as to be able to releasably engage in fully enclosed fashion said storage compartment in the dismantled condition of said bucksaw; whereby said bucksaw forms part of a combination tool assembly where each one of said at least one tool can be used independently from each another, when released from said storage compartment.

* * * * *